US006101862A

United States Patent [19]

Rzasa et al.

[11] Patent Number: 6,101,862

[45] Date of Patent: Aug. 15, 2000

[54] HYDRAULIC COMPRESSION TOOL

[75] Inventors: Michael P. Rzasa, Nashua; Armand T. Montminy, Manchester, both of N.H.

[73] Assignee: Framatome Connectors USA, Inc., Fairfield, Conn.

[21] Appl. No.: 09/082,261

[22] Filed: May 20, 1998

[51] Int. Cl.[7] ..... H01R 43/042

[52] U.S. Cl. ..... 72/413; 72/416; 29/751

[58] Field of Search ..... 72/412, 416, 476, 72/409.16, 409.14, 409.01, 413; 29/751, 753

[56] References Cited

U.S. PATENT DOCUMENTS

| | | | |
|---|---|---|---|
| 2,746,327 | 5/1956 | Runde | 72/409.16 |
| 2,761,339 | 9/1956 | Lazar | 72/409.16 |
| 3,644,989 | 2/1972 | Morby | 29/628 |
| 4,136,549 | 1/1979 | Lytle et al. | 72/453 |
| 4,292,833 | 10/1981 | Lapp | 72/409.01 |
| 4,947,672 | 8/1990 | Pecora et al. | 72/453 |
| 5,193,379 | 3/1993 | Ferraro | 72/412 |
| 5,291,772 | 3/1994 | Ferraro | 72/476 |
| 5,421,186 | 6/1995 | Lefavour | 72/409.01 |
| 5,649,445 | 7/1997 | Levoie | 72/409.16 |
| 5,780,139 | 7/1998 | Carter | 72/481.1 |

OTHER PUBLICATIONS

Framatome Connectors Burndy Electrical, Electrical Master Catalog, p. N–19, N–26, 1996.

*Primary Examiner*—Daniel C. Crane
*Attorney, Agent, or Firm*—Perman & Green, LLP

[57] ABSTRACT

A hydraulic compression tool having a compression head with a frame and a movable ram. The ram has a first compression die removably mounted thereon. The first compression die has a front end with a connector contact surface and a rear end connection section. The front end connector contact surface has a general pyramid shape and two front facing flat sections extending from two opposite sides of the general pyramid shape. The outer perimeter of the front end of the connector contact surface, at two other opposite sides of the general pyramid shape, does not extend outward past the base of the pyramid shape at the two other opposite sides.

12 Claims, 7 Drawing Sheets

HYDRAULIC COMPRESSION TOOL

BACKGROUND OF THE INVENTION

1. Field of the Invention

The present invention is related to a compression tool, and more particularly, to a compression tool for crimping electrical connectors onto conductors.

2. Prior Art

U.S. Pat. No. 5,291,772 discloses an electrical connector crimping tool having a head with a stationary anvil and a movable ram. Another example of a tool for installing a connector body is disclosed in U.S. Pat. No. 4,136,549.

SUMMARY OF THE INVENTION

In accordance with one embodiment of the present invention, a hydraulic compression tool is provided, having a compression head with a frame and a movable ram. The ram has a first compression die removably mounted thereon. The first compression die has a front end with a connector contact surface and a rear end connection section. The front end connector contact surface has a general pyramid shape and two front facing flat sections extending from two opposite sides of the general pyramid shape. The outer perimeter of the front end of the connector, at two other opposite sides of the general pyramid shape, does not extend outward past a base of the pyramid shape at the two other opposite sides.

In accordance with a method of the present invention, a method of crimping an electrical connector onto an electrical conductor in a hydraulic compression tool is provided. The method comprises the steps of removably connecting a first compression die to a movable ram of the tool, optionally connecting a second compression die to a frame of the tool and moving the ram to thereby move the first compression die to compress a connector against the second compression die. The first compression die has a front end with a connector contact surface. The connector contact surface has a general pyramid shape and two front facing flat sections extending from two opposite sides of the base of the general pyramid shape. The second compression die is optionally connected to the frame of the tool at a second compression die seat opposite the first compression die. The ram moves the first compression die to compress a connector against the second compression die when the second compression die is connected to the frame. Alternatively, when the second compression die is not connected to the frame, the step of moving the ram thereby moves the first compression die to compress a connector directly against the frame at the second compression die seat. The step of optionally connecting the second compression die to the frame is dependent upon the size of the connector being compressed. The second compression die is connected to the frame when crimping small connectors such that a maximum ram stroke of the ram can crimp the small connectors.

In accordance with another embodiment of the present invention, a hydraulic compression tool is provided. The hydraulic compression tool has a compression head comprising a frame, a ram and an indent die. The ram is movably mounted to the frame. The indent die is adjustably connected to the ram. The indent die has at least two different positions on the ram to provide at least two different working strokes for the ram and indent die.

BRIEF DESCRIPTION OF THE DRAWINGS

The foregoing aspects and other features of the invention are explained in the following description, taken in connection with the accompany i ng drawings, wherein.

DETAILED DESCRIPTION OF THE PREFERRED EMBODIMENTS

Figure 1:
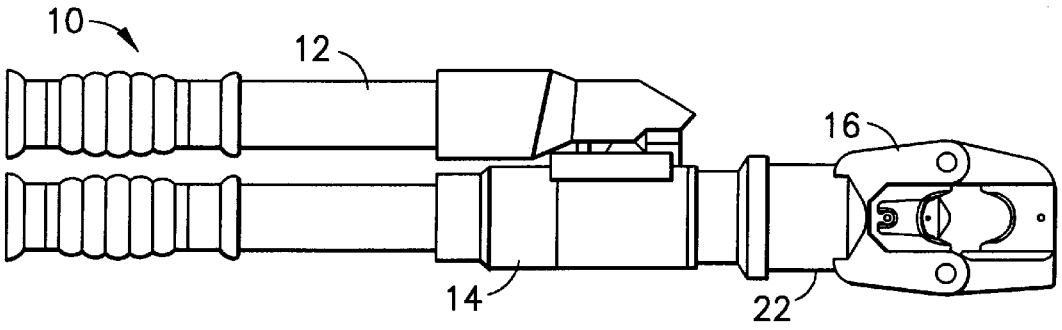
FIG. 1 is a side elevation view of a hydraulic compression tool incorporating features of the present invention.

Referring to FIG. 1, there is shown a side elevation view of hydraulic compression tool 10 incorporating features of the present invention. Although the present invention will be described with reference to the embodiments shown in the drawings, it should be understood that the present invention may be embodied in many forms of alternative embodiments. In addition, any suitable size, shape or type of materials or elements could be used.

The features of the present invention described herein are described with reference to the manually operated embodiment of the hydraulic compression tool 10 shown in FIG. 1, though the features of the present invention also apply to other types of compression tools such as a battery operated hydraulic compression tool. The hydraulic compression tool 10 generally comprises a handle section 12, a hydraulic power section 14, and a compression head 16 (see FIG. 1). The handle section 12 is located at one end of the tool 10 and allows an operator to hold and operate the tool 10. The power section 14 is located at the center of the tool 10, between the handle section 10 and the compression head 16. With the exception of the compression head 16, the hydraulic power tool 10 shown in FIG. 1 is essentially the same as the hydraulic compression tool shown and described in U.S. Pat. No. 4,947,672, which is hereby incorporated by reference herein in its entirety.

Figure 2:
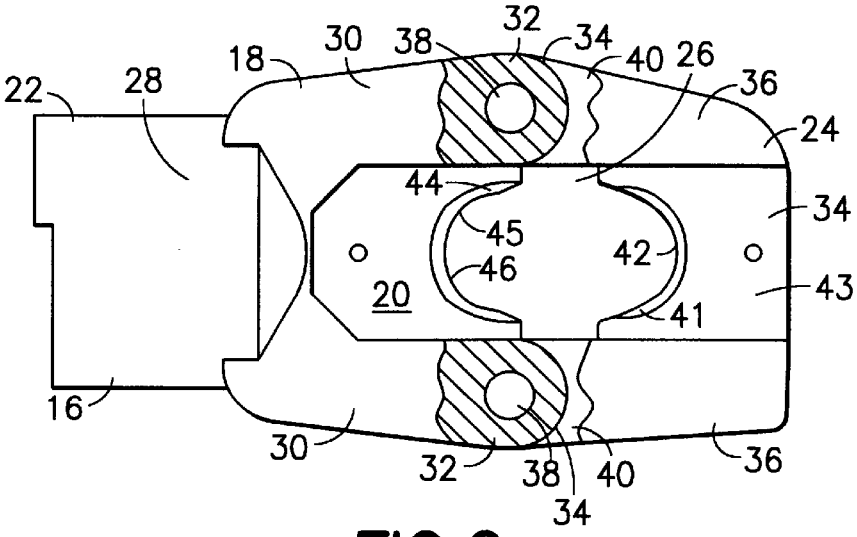
FIG. 2 is a first side elevation view of a compression head of the hydraulic compression tool shown in FIG. 1.

Referring also to FIG. 2, there is shown a side elevation view of the compression head 16 of the compression tool 10. The compression head 16 generally comprises a frame 18 and a movable ram 20. The movable ram 20 is drivingly connected to the power section 14 so that the ram 20 may be axially translated. The frame 18 of the compression head 16 has a base portion 22 and a front potion or anvil 24. The base portion 22 connects the compression head 16 to the power section 14 (see FIG. 1). The anvil 24 of the compression head 16 is supported from the base portion 22. The anvil 24 and base portion 22 form a connector holding area 26 within the frame 18 of the compression head 16. The movable ram 20 is movably mounted to the base portion 22 of the frame 18 allowing the ram 20 to move, within the connector holding area 26, towards and away from the anvil 24. Generally, an operator holds the tool 10 by its handle section 12 and operates the power section 14 to drive the movable ram 20 against the anvil 24 crimping a compression connector (not shown) in the connector holding area 26 onto a conductor within the compression connector. The base portion 22 of the frame 18 has a center section 28 with two outer support legs 30 cantilevered therefrom. The movable ram 20 extends into the compression head 16 through a passageway (not shown) in the center section 28 of the base portion 22. The outer support legs 30 are located sufficiently apart to allow the movable ram 20 to translate back and forth between the legs 30. Each leg 30 has an ear 32 located at the front end 34 of the leg.

The anvil 24 comprises a mid section 34 and two end sections 36. The end sections 36 are generally elongated members extending longitudinally from the sides of the spanwise mid section 34 of the anvil 24. The end sections 36 of the anvil 24 are joined to the legs 30 of the base portion 22 by two pins 38. Each end section 36 of the anvil 24 terminates in a clevis 40 adapted to mate with an ear 32 of the legs 30 on the base portion 22. When the anvil 24 is joined to the base portion 22, the ears on the legs 30 of the base portion 22 are located in the corresponding devises 40 of the end sections 36 of the anvil 24. The pins 38 extend through the holes in the devises 40 and mating ears 32 thereby connecting the end sections 36, and hence the anvil 24, to the legs 30 of the base portion 22 of the compression head 16. The connector holding area 26 in the frame 18 of the compression head 16 is bounded laterally by the legs 30 of the base portion 22 and end sections 36 of the anvil 24 and longitudinally by the center section 28 of the base portion 22 and mid section 34 of the anvil 24. In the preferred embodiment, one of the pins 38 is removable, so that when the pin 38 is removed the anvil 24 may pivot about the remaining pin 38 to open the connector holding area 26 in the compression head 16. In alternate embodiments, the anvil may include a latch which when opened allows at least a part of the anvil to pivot about one of the pins 38 in order to open the connector holding area of the compression head. When the connector holding area 26 of the compression head 16 is closed, the spanwise mid section 34 of the anvil 24 is located substantially in front of the ram 20. The mid section 34 has an inner surface 41 facing the connector holding area 26. The inner surface 41 has a curved connector contact seat 42 formed therein facing the ram 20. The mid section 34 of the anvil 24 has two lateral sides 43 which are substantially flat (see FIG. 10).

Still referring to FIGS. 1 and 2, the movable ram 20 has a rear section (not shown) adapted to be pushed forward and pulled backward by the power section 14 of the tool 10. As described previously, the ram 20 is movably mounted to the frame 18 for movement towards and away from the anvil 24 of the compression head 16. The ram 20 has a front end 44 located within the connector holding area 26 of the compression head 16. The front end 44 of the ram 20 has a leading edge 45 facing the anvil 24. A die receiving seat 46 is formed into the leading edge 45 of the ram 20. The seat 46 has a predetermined curvature which recesses the seat 46 into the front end 44 of the ram 20. The lateral sides 47 of the front end 44 of the ram 20 are substantially flat (see FIG. 10).

Figure 3:
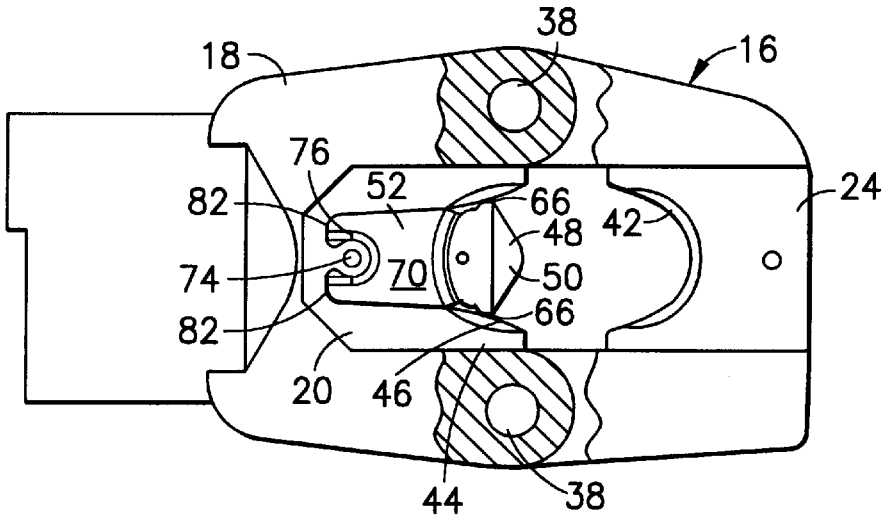
FIG. 3 is a second side elevation view of a compression head shown in FIG. 2, showing an indent die attached to the compression head.
Figure 4:
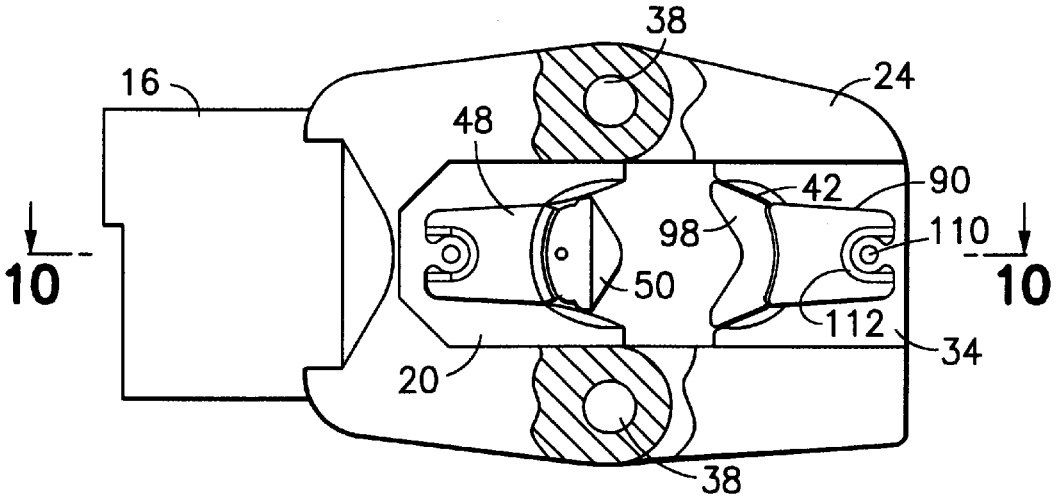
FIG. 4 is a third side elevation view of the compression head shown in FIG. 2, showing the indent die and a nest die attached to the compression head.
Figure 5:
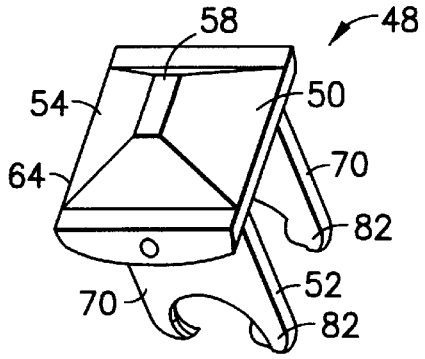
FIG. 5 is a perspective view of the indent die shown in FIG. 3.
Figure 6A:
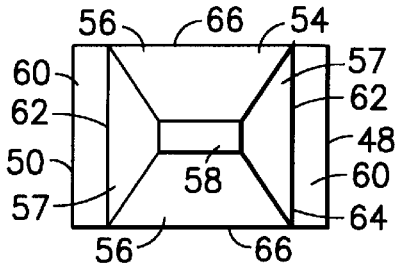
FIGS. 6A–6C are respectively a top plan view, a side elevation view and a front elevation view of the indent die of FIG. 5.
Figure 6B:
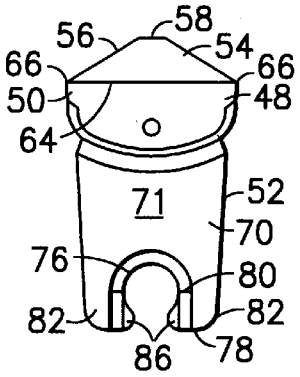
Figure 6C:
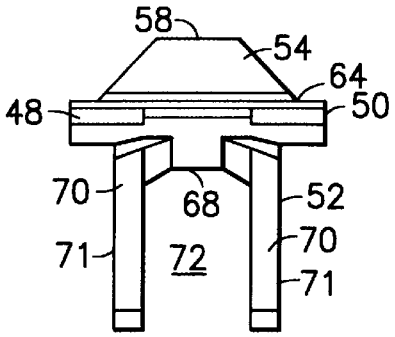
Figure 7:
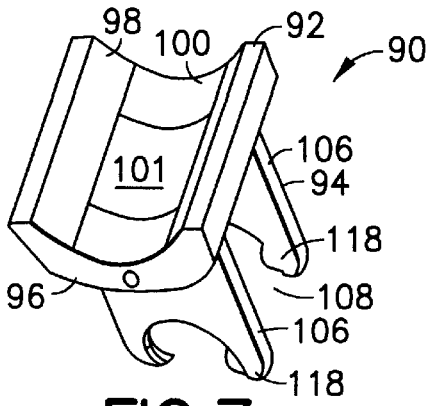
FIG. 7 is perspective view of the nest die shown in FIG. 4.
Figure 8A:
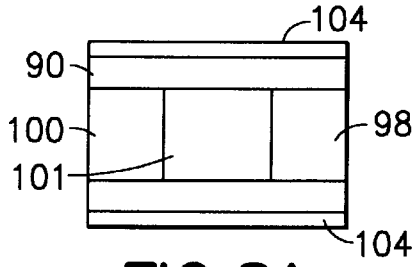
FIGS. 8A–8C are respectively a top plan view, a side elevation view and a front elevation view of the nest die of FIG. 7.
Figure 8B:
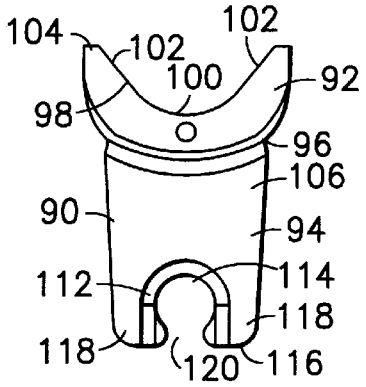
Figure 8C:
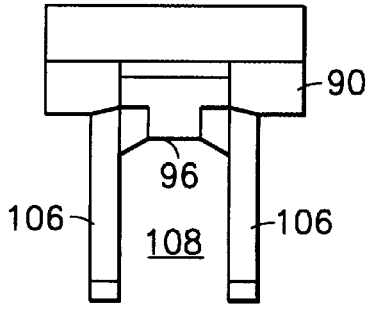
Figure 10:
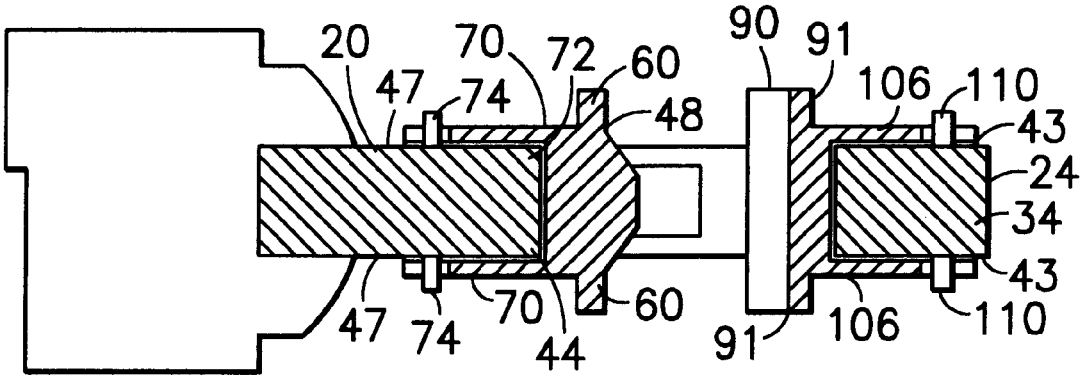
FIG. 10 is a cross-sectional view of the compression head shown in FIG. 4 taken through line 10—10.

Referring now to FIG. 3, there is shown a side elevation view of the compression head 16 of the tool 10 having an indent die 48. The indent die 48 is removably mounted to the front end 44 of the movable ram 20. FIG. 5 shows a perspective view of the indent die 48. The indent die 48 has a front end 50 and a rear end connection section 52. Referring also to FIGS. 6A–6C, the front end 50 of the indent die 48 has front connector indent surface 54 which has a general pyramidal shape. The pyramidal shape of the front indent surface 54 has four sides 56, 57. Two sides 56 are longitudinal and the other two sides are lateral sides 57. The pyramidal shape has a truncated apex which gives the indent surface a substantially flat rectangular top 58. Two ledges 60 project from opposite sides 62 of the base 64 of the pyramidal shape. The remaining two sides 66 of the base 64 of the pyramidal shape, athwart the sides 62 with the ledges 60, are substantially flush with the base 64 of the pyramid. The front end 50 of the indent die 48 has a curved bottom surface 68 conforming to the curvature of the die receiving seat 46 in the ram 20. The rear end connection section 52 of the indent die 48 includes two substantially parallel mounting legs 70 cantilevered from the bottom 68 of the front end 50 of the die 48 (see FIG. 6C). The legs 70 have a general flat bar shape. The mounting legs 70 are oriented relative to the front end 50 of the die 48 so that the ledges 60 extend past the flat sides 71 of the legs 70. The mounting legs 70 are separated by a gap 72 of sufficient size to admit the front end 44 of the movable ram 20 (see FIG. 10). When the indent die 48 is installed on the movable ram 20 as shown in FIG. 3, the front end 44 enters the gap 72 thereby placing the mounting legs 70 of the die 48 astride the front end 44 of the ram 20 with the flat sides 71 of the legs being substantially parallel to the lateral sides 47 of the front end 44 of the ram 20. The indent die 48 is installed on the ram 20 by sliding the rear end connection section 52 over the leading edge 45 of the ram 20 until the bottom surface 68 of the front end 50 of the die 48 is seated in the curved die receiving seat 46 of the ram 20. When the die 48 is seated on the ram 20, the sides 66 of the front end 50 of the die 48, which are flush with the base 64 of the pyramidal shape, rest against the curved die receiving seat 46 of the ram 20 (see FIG. 3). The ledges 60 on the die 48 extend laterally past the sides 47 of the front end 44 of the ram 20 (see FIG. 10). The indent die 48 is held on the front end 44 of the ram 20 by detents 74 which engage locating surfaces 76 on the die 48. The detents 74 and locating surfaces 76 cooperate in a spring loaded manner which allows a user to affix or remove the die 48 from the ram 20, but otherwise holds the die 48 in the receiving seat 46 of the ram 20. In the preferred embodiment, the detents 74 project from the lateral sides 47 of the front end 44 of the ram 20 as shown in FIG. 10. The detents 74 move in and out of the lateral sides 47 of the ram 20, and are spring loaded to provide an outward bias. The locating surfaces 76 are located on the mounting legs 70 of the indent die 48. Each mounting leg 70 has a locating surface 76 (see FIG. 5). The bottom edge 78 of each leg 70 has a "C" shaped hole 80 which forms the locating surface 76 of the leg 70. The "C" shaped hole 80 provides the bottom edge 78 of each leg 70 with two guide arms 82. Hence, each mounting leg 70 has two guide arms 82. As shown in FIG. 6B, the guide arms 82 have facing cam surfaces 86. The cam surfaces 86 co-act with the corresponding detents 74 to resiliently depress the spring loaded detents 74 when the user slides the die 48 along the ram 20. When the die 48 is affixed to the ram 20, the detents 74 are resiliently depressed inward to pass under the guide arms 82 then resile outwards to enter the "C" shaped holes 80 in the mounting legs 70 of the die 48 (see FIG. 3). Once the detents 74 are located in holes 80, the detents 74 cooperate with the locating surfaces 76 to hold the indent die 48 in the die receiving seat 46 of the ram 20 until the die 48 is otherwise removed by the user. In alternate embodiments, the indent die may be removable held to the ram by any other suitable spring loaded means such as a spring loaded detent in the die engaging a mating locating surface of the ram. In still other alternate embodiments, the die may be removably mounted to the ram by any other suitable removable mounting means. For example, a removable pin extending through holes in the mounting legs of the die and the ram may be used to removably connect the die to the ram. Referring now to FIG. 4, the compression head 16 of the tool 10 is adapted to have a nest die 90 removably mounted thereto. The nest die 90 is removably mounted to the mid section 34 of the anvil 24. FIG. 7 shows a perspective view of the nest die 90. The nest die 90 comprises a rear end 92 and a front end connection section 94. Referring also to FIGS. 8A–8C, the rear end 92 has a general trough shape with a curved outer or front seat surface 96 and a generally curved inner or rear surface 98. The curvature of the front seat surface 96 generally conforms to the curvature of the connector contact seat 42 in the mid section 34 of the anvil 24. The rear surface 98 of the rear end 92 of the nest die 90 is also a connector contact seat surface. The rear surface 98 is rounded at the bottom 100 with opposingly sloped sides 102 extending to the trailing edges 104 of the die 90. As shown in FIGS. 7 and 8A, the bottom 100 of the rear surface 98 has a recess 101 located substantially in the center of the rear surface 98. The angle of the slope of the sides 102 on the rear surface 98 of the nest die 90 is substantially the same as the slope of the longitudinal sides 56 of the pyramid shaped indent surface 54 on the indent die 48. The trailing edges 104 of the nest die 90 are substantially flat and extend for the entire width of the rear end 92 of the nest die 90. The rear end 92 of the nest die 90 has substantially the same width as the front end 50 of the indent die 48 (see FIGS. 6A & 8A). The front end connection section 94 of the nest die 90 includes two mounting legs 106 substantially similar to the mounting legs 70 of the indent die 48. The mounting legs 106 of the nest die 90 are substantially parallel with each other. A gap 108 is adapted to admit the mid section 34 of the anvil 24 separates the mounting legs 106 as shown in FIGS. 4 and 8C. The mounting legs 106 are aligned substantially perpendicular to the trough shaped rear end 92 of the nest die 90. The nest die 90 is installed on the anvil 24 of the compression head 16 by sliding the front connection section 94 of the die 90 over the mid section 34 of the anvil 24 so that the mid section 34 enters the gap 108 between the legs 106 of the die 90 (see FIG. 10). When the nest die 90 is installed, the die 90 is seated in the connector contact seat 42 of the anvil 24 with the rear surface of the nest die 90 facing the indent die 48 installed on the ram 20 of the compression head 16 (see FIG. 4). The nest die 90 is removably held in the seat 42 on the anvil 24 by spring loaded detents 110 on the lateral sides 43 of the mid section 34 which engage locating surface 112 on the mounting legs 106 of the nest die 90. The detents 110 and locating surfaces 112 removably holding the nest die 90 on the anvil 24 are substantially the same as the detents 74 and locating surfaces 76 removably holding the indent die 48 to the ram 20. The detents 110 on the anvil 24 project laterally from the sides 43 of its mid section 34. The detents 110 move in and out of the sides 43 and are spring loaded to maintain an outward bias. The locating surfaces 112 on the nest die 90 are formed by "C" shaped holes 114 in the leading edges 116 of the mounting legs 106 (see FIG. 8B). The detents 110 are resiliently depressed by the guide arms 118 at the mouth 120 of each of the "C" shaped holes 114 to enter and exit the "C" shaped holes 114 when the nest die 90 is respectively installed or removed from the mid section 34 of the anvil 24. When the nest die 90 is seated on the anvil 24, side sections 91 of the die 90 extend laterally past the sides 43 of the mid-section 34 (see FIG. 10). In an alternate embodiment, the nest die could be formed with a front end mounting section which has a C-shape to be received in a mating seat of the compression head rather than the two mounting legs 106. Likewise, the indent die could have its legs 70 replaced with a C-shaped mounting section to be received in a mating seat of the ram.

Figure 11:
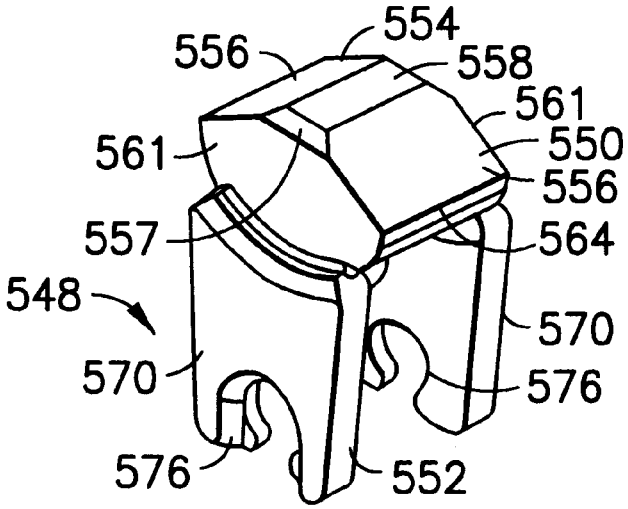
FIG. 11 is a perspective view of a first alternate embodiment of the indent die.
Figure 12:
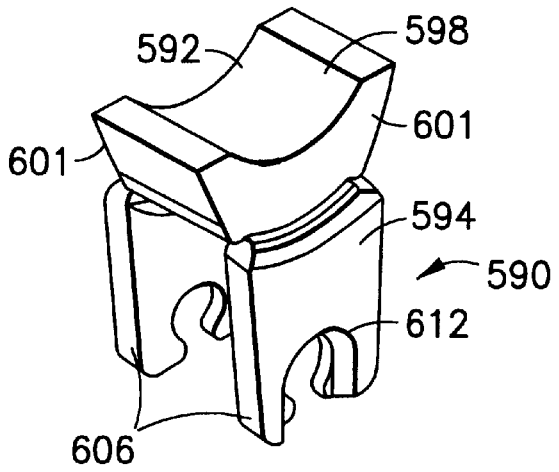
FIG. 12 is a perspective view of a first alternate embodiment of the nest die.

FIGS. 11 and 12 show a first alternate embodiment of an indent die 548 and a nest die 590. The indent die 548, shown in FIG. 11, is similar to the indent die 48 described previously and shown in FIGS. 5, 6A–6C. The indent die 548 has a front indent end 550 and a rear end connection section 552. As in the indent die 48 (see FIG. 5), the rear end connection section 552 of indent die 548 comprises a pair of parallel mounting legs 570 spaced apart to admit the ram 20. The mounting legs 570 have locating surfaces 576 to lock on the detents 74 of the ram 20 when the indent die 548 is mounted on the ram 20. The front end 550 of the indent die 548 spans between the mounting legs 570. The front end 550 has two lateral sides 561 extending substantially straight from the mounting legs 570 (see FIG. 11). The front end 550 of the indent die 548 has a front indent surface 554 with two longitudinal sides 556 sloped inwards from the base 564 to the flat top 558 of the front indent surface. Two small sloped lateral sides 557 athwart the longitudinal sides 556 connect the flat top 558 of the front indent surface 554 to the lateral sides 561 of the front end 550.

Referring now to FIG. 12., the nest die 590 of this first alternate embodiment is similar to the nest die 90 described previously and shown in FIGS. 7, 8A–8C. The nest die 590 depicted in FIG. 12 has a front end connection section 594 and a rear end 592. The front end connection section 594 comprises two mounting legs 606 spaced apart to receive the mid section 34 of the anvil 24 therebetween. The mounting legs 606 have locating surfaces 612 to engage the detents 110 on the anvil 24 when the nest die 590 is mounted on the anvil. The rear end 592 of the nest die 590 has a general trough configuration. The rear surface of the 598 of the trough like rear end 592 is curved to allow seating of a connector. The rear end 592 of the nest die 590 spans between lateral sides 601 of the nest die which extend from the mounting legs 606 of the nest die (see FIG. 12).

Figure 13:
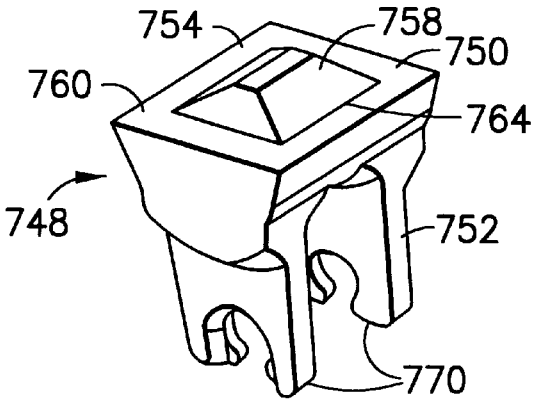
FIG. 13 is a perspective view of a second alternate embodiment of the indent die.
Figure 14:
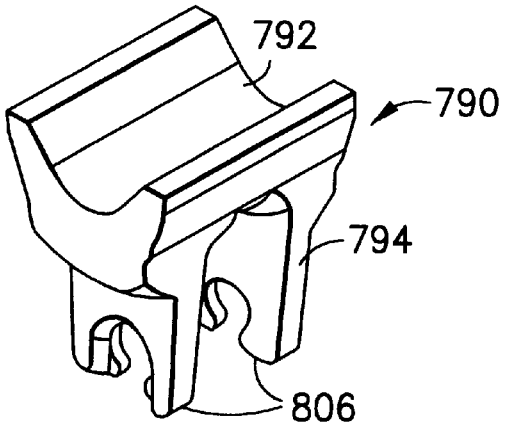
FIG. 14 is a perspective view of a second alternate embodiment of the nest die.

FIGS. 13 and 14 show a second alternate embodiment of an indent die 748 and a nest die 790. The indent die 748 is also similar to the indent die 48 as described previously and shown in FIGS. 5, 6A–6C. The indent die 748 has a front indent end 750 and a rear connection section 752. The rear connection section 752 of the indent die 748 is substantially the same as the rear connection section 52 of the indent die 48 (see FIGS. 5 and 13). The front indent end 750 of the indent die 748 has a front indent surface 754 which has a central pyramidal frustum 758 with a ledge 760 extending around the base 764 of the frustum. The ledge 760 extends beyond the legs 770 of the rear connection section 752 of the indent die 748.

Referring now to FIG. 14, the nest die 790 of this second alternate embodiment is substantially similar to the nest die 90 described previously and shown in FIGS. 7, 8A–8C. The nest die 790 has a front end connection section 794 and a rear end 792. The front end connection section 794 has two mounting legs 806 for mounting and locking the nest die onto the mid section 34 of the anvil 24. The rear end 792 of the nest die 790 has a general trough configuration adapted to allow a connector to be seated therein. The rear end 792 of the nest die 790 has substantially the same width as the front indent surface 754 of the indent die 748.

Referring now to FIGS. 1, 3 and 4, the hydraulic compression tool 10 is used to install a compression connector onto a conductor (not shown). The compression tool 10 may be used both with and without the nest die 90 affixed to the anvil 24 of the compression head 16. The nest die 90 is selected to be affixed to the compression head 16 only when the compression connector being installed has a diameter smaller than a predetermined size. However, the indent die 48 is usually attached to the ram 20 when the tool 10 is used to install a connector on a conductor. The procedure to install the compression connector onto a conductor is substantially the same whether the nest die 90 is attached to the compression head 16 or not. The installation procedure is substantially as follows. The connector holding area 26 in the compression head 16 of the tool 10 is opened (in the present case by removing the removable pin 38 and pivoting the anvil 24 around the remaining pin 38) and the compression contact of a connector (not shown) is placed therein. The conductor is placed within the compression contact of the connector. The connector holding area 26 of the compression head 16 is then closed (in the present case by reinstalling the removed pin 38 to join the anvil 24 to the base portion 22). After the connector holding area 26 is closed, the operator holds the tool 10 by the handle section 12 and operates the power section to drive the movable ram 20 in the compression head 16 toward the anvil 24. As the ram 20 moves towards the anvil 24, the indent die 48 impinges on the compression contact of the connector and thrusts the contact towards the anvil 24. When the nest die 90 is affixed to the anvil 24 of the compression head 16, the indent die 48, under the impetus of the movable ram 20, seats the contact of the connector into the curved rear surface 98 of the nest die 90 (see FIG. 4). When the nest die 90 is not installed on the anvil 24, the indent die 48 seats the contact of the connector into the connector contact seat 42 on the mid section 34 of the anvil 24 (see FIG. 3). After the compression contact of the connector is seated, the ram 20 continues to move towards the anvil 24 compressing the contact between the indent die 48 and either the nest die 90 or mid section 34 of the anvil 24. The operator maintains power on the ram 20 to compress the contact until the indent die 48 deforms the compression contact sufficiently to clamp the conductor therein. Upon crimping the connector to the conductor, the operator operates the power section 14 to relieve the hydraulic pressure and reverse the direction of movement of the ram 20 (i.e. away from the anvil 24). As the ram 20 moves away from the anvil 24, the connector is released from the crimping pressure applied by the ram 20. The connector holding area 26 is then opened and the connector with the conductor now attached is removed from the compression head 16 of the tool 10.

During the installation of a compression connector onto a conductor, the nest and indent dies 90, 48 interact to prevent over crimping of the compression connector. As noted previously, the nest die 90 is affixed to the anvil 24 when the tool 10 is used to install connectors of small diameter. Connectors of small diameter have a small stress bearing area and thus may be easily over crimped when being installed by a hydraulic compression tool. One reason for this is that the operator of the tool receives little feedback as to the pressure being applied on the compression connector. Furthermore, small movements of the ram are difficult to control when operating the hydraulic power source of the tool. The present invention avoids over crimping of connectors as a result of the interaction between the ledges 60 on the indent die 48 and the nest die 90. The ledges 60 on the indent die 48 act as abutting surfaces when the ram 20 is being moved to crimp the connector. The ledges 60 are located relative to the top 58 of the indent die 48 so that, when installing a compression connector onto a conductor, the front indent surface 54 advances into and deforms the connector sufficiently to crimp the connector. However, the ram 20 is prevented from advancing the indent die further into the connector, and hence from over crimping the connector, by contact between the ledges 60 and the surface area of the connector around the indent surface 54 projecting into the connector. Thus, the ledges 60 effectively redistribute the force of the ram 20 over a larger bearing area of the connector to prevent the pyramid projection from piercing through the connector. The nest die 90 also acts to prevent over crimping of the connector by distributing the clamping pressure generated between the ram 20 and anvil 24 over a large bearing area of the connector. The nest die 90 has a predetermined width selected to provide an optimum bearing area. During compression of the connector, the ram 20 seats the connector into the rear surface 98 of the nest die 90. Initially, the connector contacts the bottom 100 of the nest die 90 except over the recess 101 (see FIG. 7 and 8A). Under continued pressure from the indent surface 54 of the indent die 48 on the ram 20, the portion of the connector initially unsupported over the recess 101 deforms into the recess 101, thus further crimping the connector onto the conductor. When the connector deforms in to the recess 101, the crimping load on the connector is redistributed over substantially the entire width of the nest die 90 to prevent over crimping the connector.

Figure 9A:
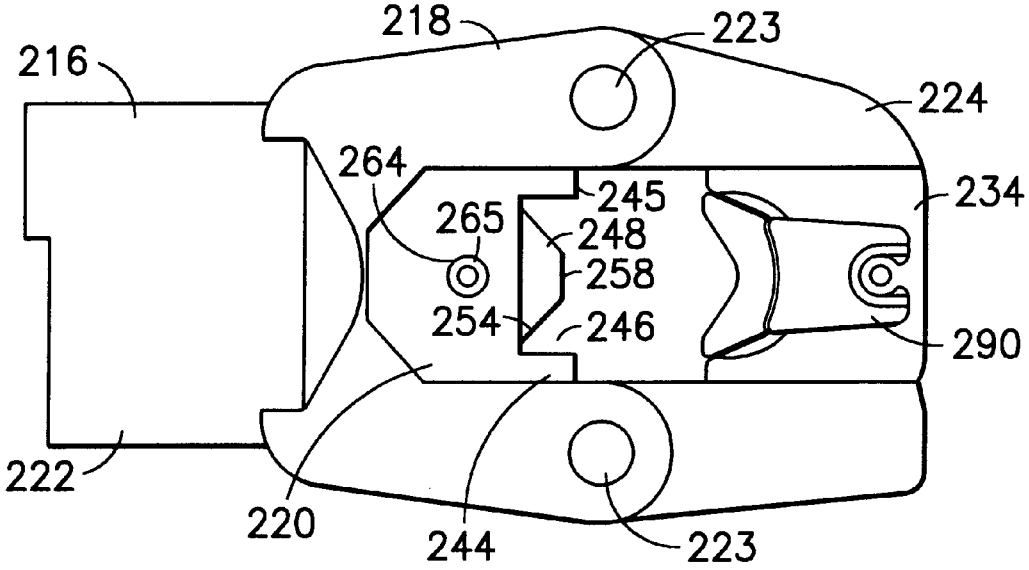
FIG. 9A is a side elevation view of a compression head of the hydraulic compression tool shown in FIG. 1, wherein the compression head incorporates features of an alternate embodiment of the present invention.

Referring now to FIG. 9A, there is shown a side elevation view of a compression head 216 incorporating features of an alternate embodiment of the present invention. The compression head 216 of this alternate embodiment of the present invention is substantially similar to the compression head 16 of the embodiment of the invention shown in FIGS. 2–4. The compression head 216 of the alternate embodiment has a frame 218 and a movable ram 220. The frame 218 has a base section 222 and an anvil 224 connected to each other by two pins 223. The anvil 224 is adapted to hold onto a mid section 234 thereof a nest die 290 substantially the same as the nest die 90 of the embodiment of the invention shown in FIGS. 7, 8A–8C. The nest die 290 is removable mounted to the anvil 224 of the compression head 216. With the exception of its front end 244, the ram 220 of this alternate embodiment is substantially the same as the ram 20 of the embodiment of the present invention shown in FIGS. 1 and 2. Still referring to FIG. 9A, the ram 220 is movably mounted to the frame 218 of the compression head 216 so that the ram 220 may move towards and away from the anvil 224. The front end 244 of the ram 220 has a leading edge 245 with a recess 246 formed therein. The recess 246 is adapted to admit an indent die 248 therein. The indent die 248 is adjustably connected to the front end 244 of the ram 220.

Figure 9B:
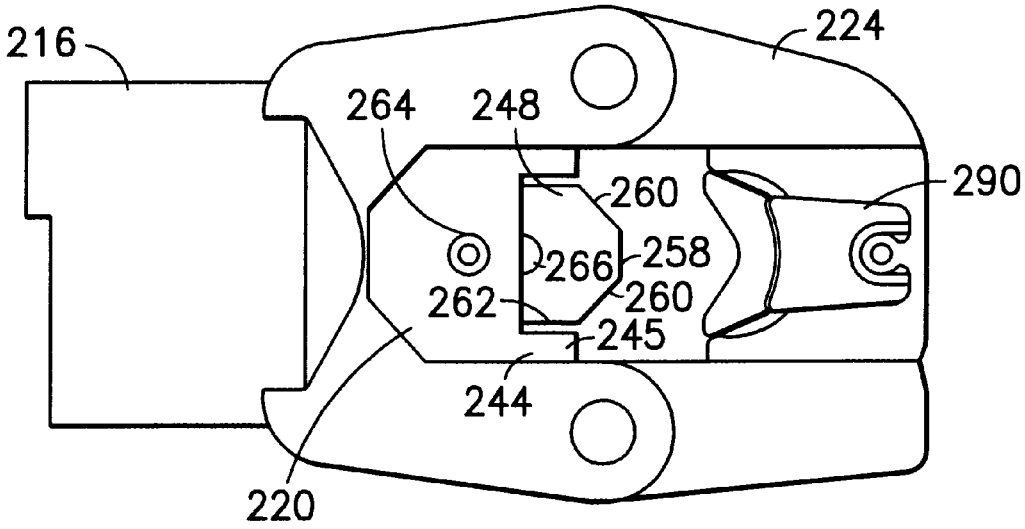
FIG. 9B. is a side elevation view of the compression head shown in FIG. 9A, showing an indent die of the compression head in a second position.

The position of the indent die 248 may be adjusted relative to the front end 244 of the ram 220 between a retracted position, shown in FIG. 9A, and a deployed position shown in FIG. 9B. The indent die 248 may also be placed in a third or intermediate position (not shown) between the retracted and deployed positions. The indent die 248 has a front indent surface 254 which has a substantially flat top 258. Two angled sides 260 extend between the top 258 of the indent surface 254 and the longitudinal sides 262 of the indent die 248. The indent die 248 is held to the ram 220 by a removable connecting pin 264. The connecting pin 264 extends through mounting holes 265 in the front end 244 of the ram 220 and one of the position adjustment holes 266 in the die 248. The indent die 248 has three position adjustment holes 266; a front, an intermediate and a rear hole (only the front hole 266 is shown in FIG. 9B). The holes 266 are located on the die 248 to correspond to the three positions of the indent die 248 relative to the ram 220. When the connecting pin 264 is inserted in the rear position adjustment hole 266 of the indent die 248 the die 248 is in its deployed position (see FIG. 9B), when the pin 264 is located in the intermediate hole the die 248 is in its intermediate position, and when the pin 264 is inserted into the front position adjustment hole 266 the die 248 is in its retracted position (see FIG. 9A). To move the indent die 248 between positions, the connecting pin 264 is removed from the die, the die 248 is moved to the required position and the pin 264 is then reinserted into the corresponding hole 266 in the die 248. As shown in FIG. 9A, in the retracted position the front indent surface 254 of the indent die 248 is somewhat recessed below the leading edge 245 of the ram 220. In the deployed position, shown in FIG. 9B, the front indent surface 254 of the indent die 248 projects longitudinally in front of the leading edge 245 of the ram 220.

Operation of the compression head 216 shown in FIGS. 9A, 9B is substantially similar to the operation described previously of the compression head 16 of the embodiment of the present invention shown in FIGS. 2–4. The compression connector (not shown) is placed in the connector holding area 226 of the compression head 216 and the ram 220 is moved towards the anvil 224 to compress and deform the compression connector onto a conductor. Unlike the compression head 16 of the embodiment of the invention shown in FIGS. 2–4, the nest die 290 on the compression head 216 shown in FIGS. 9A, 9B is usually attached to the anvil 224 when installing the compression contact. The indent die 248 is placed in its retracted position, shown in FIG. 9A, when installing compression connectors having a diameter larger than a predetermined size. When installing compression connectors with a diameter smaller than this predetermined size, the indent die is placed in either its intermediate or in its deployed position as shown in FIG. 9B.

The embodiments of the present invention provide a compression head 16, 216 for a hydraulic power tool 10 which has an increased connector installation range capacity over the compression heads of the prior art for a given working stroke of the ram. The connector installation range capacity of the compression head is the range of diameters of compression connectors which may be properly compressed by the compression head to install the connector on a conductor. In general, the connector installation range capacity of a compression head is based on the working stroke of the ram and the length of the connector holding area in the compression head. Connectors having a diameter such that the working stroke of the ram is sufficient to compress the connector against the anvil and deform the connector so that the deformed connector clamps the conductor therein are within the connector installation range capacity of the compression head. Connectors with a diameter too large to be seated in the compression holding area of the compression head when the ram is fully retracted are outside the installation range capacity of the compression head as are connectors with a diameter that is too small to be deformed under the compression of the ram at full stroke. The ram of the compression head has a predetermined working stroke. The working stroke of the ram 20, 220 of both embodiments of the present invention is about 0.6 inch. The working stroke of the ram is limited by the length of the compression head. In the prior art, an increase in the connector installation range capacity of a compression head was achieved by using a compression head with a longer connector holding area and an increased working stroke of the ram. This required a commensurate increase in the length, and hence an increase in the weight, of the compression head of the compression tool. The heavier compression head makes handling and control of the compression tool more fatiguing on the operator. In addition, an increase in the working stroke of the ram results in longer working time and higher power demands to install connectors of small diameter. The present invention avoids these penalties. Use of the nest die 90, in the embodiment of the invention shown in FIG. 4, and use of the adjustable indent die 248, in the embodiment of the invention shown in FIGS. 9A, 9B effectively decreases the working stroke of the ram 20, 220 while still providing a compression head 16, 216 having a connector installation range capacity of #4 AWG to 500 kcmil; the working stroke of the ram 20, 220 being only about 0.6 inch. In contrast in the prior art, to achieve a connector installation range capacity of #4 AWG to 500 kcmil the working stroke of the ram was about 1.03 inches. Thus, the present invention provides a hydraulic compression tool 10 with a substantially smaller and lighter compression head thereby avoiding the weight, time and power penalties incurred by employing the hydraulic compression tools of the prior art. Furthermore, this increase in connector installation range capacity is achieved on the tool 10 of the present invention through the attachment of only one die (i.e. the nest die 90) in addition to the indent die 48, 248 usually mounted to the compression head 16, 216.

Table 1 below shows the connector installation ranges of the tool 10 for connectors employed with various types of conductors with both the nest 790 and the indent dies 748 (see FIGS. 13 and 14) and with just the indent die 748 attached to the compression head. Table 1 also shows the overall connector installation range of the tool 10 when using this alternate pair of nest 790 and indent 748 dies.

TABLE 1

CONNECTOR INSTALLATION RANGE

| Dies Attached | Conductor | Smallest Size | Largest Size |
|---|---|---|---|
| Nest and Indentor | Cu Str | #6 AWG | 250 Kcmil |
| Nest and Indentor | Cu Str/Cu Flex | #2 AWG | #4/0 AWG |
| Nest and Indentor | AL | #8 | #2/0 AWG |
| Indentor Only (No Nest Die) | Cu Str | 300 Kcmil | 400 Kcmil |
| Indentor Only (No Nest Die) | AL | #3/0 AWG | 300 Kcmil |
| OVERALL RANGE | Cu Str | #6 AWG | 400 Kcmil |
| (Indentor Die | Cu Str/Cu Flex | #2 AWG | #4/0 AWG |

TABLE 1-continued

| CONNECTOR INSTALLATION RANGE | | | |
|---|---|---|---|
| Dies Attached | Conductor | Smallest Size | Largest Size |
| With and Without Nest Die) | AL | #8 | 300 Kcmil |

Table 2 below depicts the connector installation ranges of the tool 10 for connectors employed on various types of conductors with both the nest 590 and indent 548 dies (see FIGS. 11 and 12) installed on the compression head as well as with only the indent die 548 installed. Table 2 also shows the overall range of the hydraulic compression tool when using this alternate pair of nest 590 and indent dies 548.

TABLE 2

| CONNECTOR INSTALLATION RANGE | | | |
|---|---|---|---|
| Dies Attached | Conductor | Smallest Size | Largest Size |
| Nest and Indentor | Cu Str | #4 AWG | 300 Kcmil |
| Nest and Indentor | Cu Str/Cu Flex | #2 AWG | #4/0 AWG |
| Indentor Only (No Nest Die) | Cu Str | 350 Kcmil | 500 Kcmil |
| OVERALL RANGE (Indentor Die With and Without Nest Die) | Cu Str | #4 AWG | 500 Kcmil |
| | Cu Str/Cu Flex | #2 AWG | #4/0 AWG |

The present invention increases the range taking capability of the tool (range of conductor/connector sizes the tool can crimp) while still preventing over crimping of connectors during installation. The present embodiment of the present invention shown in FIG. 4, provides a compression head 16 with anti-over compressing features (i.e. ledges 60 on the indent die 48 butting the connector and the nest die 90 having an increased width to increase the bearing area of the connector) to prevent the ram 20 from over crimping connectors during installation.

In the embodiments of the present invention, the nest die 90, 590, 790, 290 is removably attached to the anvil 24, 224 of the compression head 16, 216, and the indent die 48, 548, 748, 248 is mounted on the ram 20, 220. In alternate embodiments, the arrangement may be reversed with the nest die on the ram and the indent die on the anvil of the compression head. In other alternate embodiments, the indent die may be removably mounted in a non-adjusting manner and the nest may be adjustably mounted.

It should be understood that the above description is merely illustrative of the invention. Various alternatives and modifications can be devised by those skilled in the art without departing from this invention. Accordingly, the present invention is intended to embrace all such alternatives, modifications and variances which fall within the appended claims.

What is claimed is:

1. In a hydraulic compression tool having a compression head with a frame and a movable ram, the ram having a first compression die removably mounted thereon, wherein the improvement comprises:

the first compression die having a front end with a connector contact surface and a rear end connection section, the front end connector contact surface having a general pyramid shape and two front facing flat sections extending from two opposite sides of the general pyramid shape, wherein at two other opposite sides of the general pyramid shape, a perimeter of a base of the general pyramid shape along the two other opposite sides is substantially coincident with an outer perimeter of the front end.

2. A tool as in claim 1 wherein the rear end connection section has two spaced mounting legs removably connected to the ram.

3. A tool as in claim 1 wherein the ram has a curved first compression die receiving seat and the outer perimeter of the front end at the two other opposite sides rest against the curved seat.

4. A tool as in claim 3 wherein the two front facing flat sections extend laterally past ends of the curved seat.

5. A tool as in claim 1 further comprising a second compression die removably connected to the frame opposite the first compression die.

6. A tool as in claim 5 wherein the second compression die has a connector contact surface with a center recess.

7. A tool as in claim 5 wherein the frame has a second compression die receiving seat which the second compression die is seated against, and the second compression die has lateral end sections that extend laterally past ends of the second compression die receiving seat.

8. A tool as in claim 1 wherein the ram has a limited stroke and wherein the compression head is adapted to compress electrical connectors ranging in size from large to small connector sizes with a single selectable second compression die being removably connected to the frame opposite the first compression die when the second die is selected and disconnected from the frame when second die is not selected, and wherein the single second compression die is selected when compressing the small connector sizes.

9. A tool as in claim 8 wherein the ram has a maximum stroke of about 0.6 inch.

10. A tool as in claim 9 wherein the large to small connector sizes range from about 500 Kcmil to about #4 awg.

11. In a hydraulic compression tool having a compression head with a frame and a movable ram, the ram having a first compression die removably mounted thereon, wherein the improvement comprises:

the compression head being adapted to crimp electrical connectors ranging in size from large to small connector sizes using a single selectable second compression die mounted on the compression head, the single second compression die being selected for mounting on the compression head when crimping the small connector sizes and not being selected for mounting on the compression head when crimping the large connector sizes; and the first compression die having a front end with a crimping surface and a rear end section depending from the front end, the crimping surface comprising a general pyramid shape and two front facing ledges extending from opposite sides of the pyramid, the pyramid having two lateral sides and two longitudinal sides, and the ledges extending from the lateral sides of the pyramid, wherein the front end has an outer perimeter which is generally coincident with the longitudinal sides at a base of the pyramid.

12. In a hydraulic compression tool having a compression head with a frame and a movable ram, the ram having a first compression die removably mounted thereon, wherein the improvement comprises:

the first compression die having a front end with a connector contact surface and a rear end connection section, the front end connector contact surface having a general pyramid shape and two front facing flat sections extending from two opposite sides of the general pyramid shape, wherein at two other opposite sides of the general pyramid shape, a perimeter of a base of the general pyramid shape along the two other opposite sides is substantially level with an outer perimeter of the front end; and the hydraulic tool comprising a second compression die removably connected to the frame of the compression head opposite the first compression die.

* * * * *